United States Patent [19]

Ceribelli

[11] 4,108,064

[45] Aug. 22, 1978

[54] FEEDING APPARATUS FOR DEVICE FOR FORMING BALES OF INCOHERENT MATERIAL

[76] Inventor: Giorgio Ceribelli, Via Privata Pienza, 18, Milan, Italy, 20142

[21] Appl. No.: 671,443

[22] Filed: Mar. 29, 1976

Related U.S. Application Data

[62] Division of Ser. No. 523,374, Nov. 12, 1974, Pat. No. 3,998,147.

[30] Foreign Application Priority Data

Nov. 16, 1973 [IT] Italy ..... 31481 A/73
Sep. 4, 1974 [IT] Italy ..... 26922 A/74

[51] Int. Cl.[2] ..... B30B 15/30

[52] U.S. Cl. ..... 100/187; 100/188 R; 100/191

[58] Field of Search ..... 100/220, 187, 191, 188, 100/189, 215, 187

[56] References Cited

U.S. PATENT DOCUMENTS

| | | | |
|---|---|---|---|
| 924,107 | 6/1909 | Ritter | 100/187 |
| 2,135,379 | 11/1938 | Ambers | 100/191 |
| 2,170,084 | 8/1939 | Kruse | 100/187 |
| 2,822,750 | 2/1958 | Austin | 100/220 |
| 3,469,530 | 9/1969 | Walker | 100/220 |
| 3,762,311 | 1/1973 | Friedman | 100/187 |

*Primary Examiner*—Billy J. Wilhite
*Attorney, Agent, or Firm*—Lane, Aitken, Dunner & Ziems

[57] ABSTRACT

An apparatus for compressing material includes a hollow chamber defined by a plurality of walls, a piston-plate, and means for moving the piston-plate between maximum inner and outer limits, a hopper being in one of the walls located between those two maximum limits of movement. The apparatus further includes a plurality of engaging means located at the maximum outer limit of the piston-plate for engaging the compressed material and stopping rearward movement thereof. There is further included adjusting means for adjusting the distance between portions of the opposite walls located beyond the outer limit of the piston-plate.

4 Claims, 15 Drawing Figures

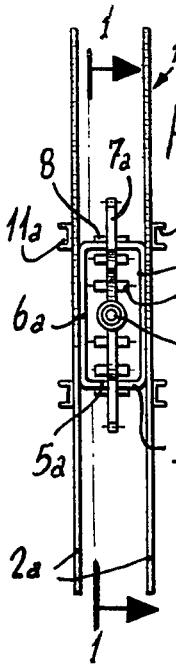
FIG. 2
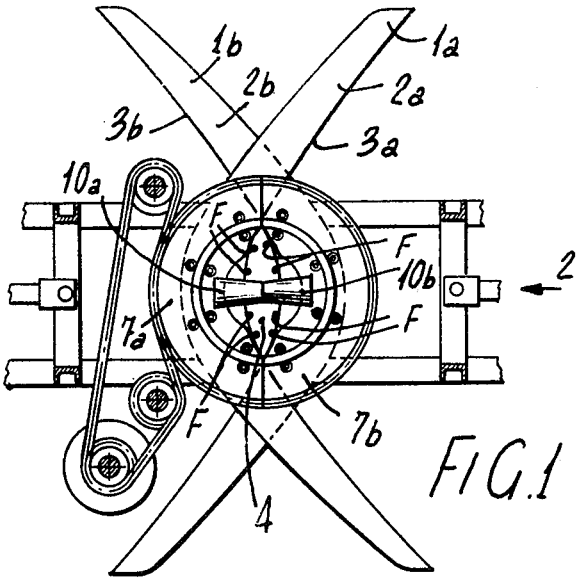
FIG. 1
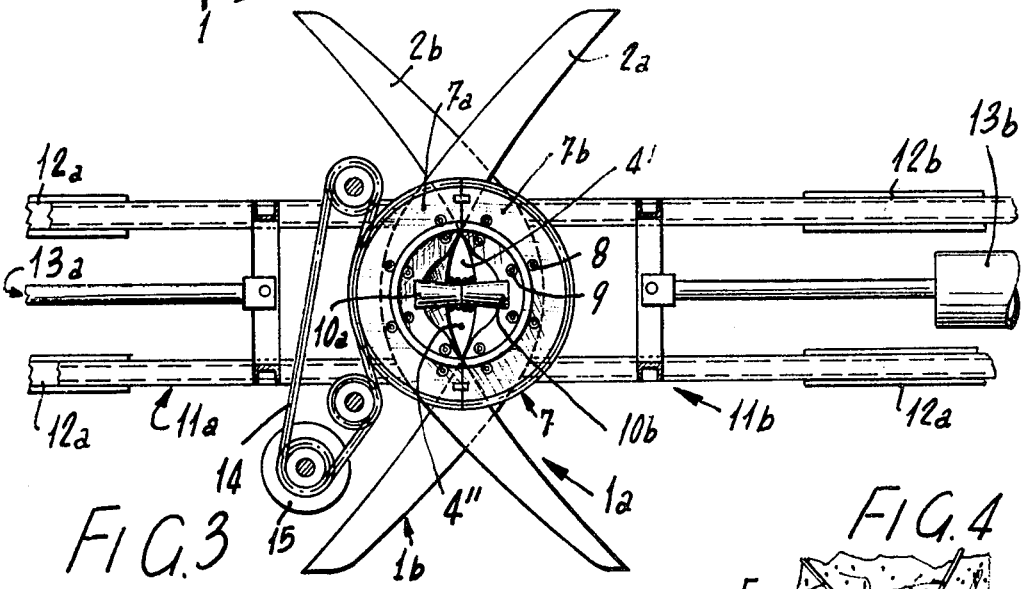
FIG. 3
FIG. 4
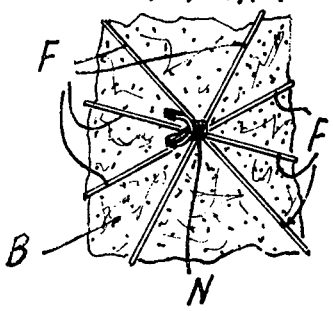

FEEDING APPARATUS FOR DEVICE FOR FORMING BALES OF INCOHERENT MATERIAL

This is a division, of application Ser. No. 523,374 filed Nov. 12, 1974 now U.S. Pat. No. 3,998,147.

BACKGROUND OF THE INVENTION

This invention is concerned with the art of binding packings or packages, or bales of paper, hay, straw and any kind of incoherent materials. For example, it is known to form bales and then bind the same by means of a string or wire. While for string-binding several mechanical apparatus have been designed capable of wrapping up the bales and then providing for knotting, wire-binding which is under some circumstances preferable with respect to string-binding is up to now manually carried out, with high time consuming and labour.

Since it is obvious that, depending on the incoherent material being handled and the weight thereof, bales of substantial overall size and relatively small bales can be obtained, it was found to be highly advantageous in large and normal factories, where waste, scraps and refuses of processed material are produced in remarkable amounts, to avail of means for readily continuously removing such refuses from the working station without any loss thereof, being the same, such as paper, reusable by supply to maceration.

In view of this, the present invention relates to a continuously operating feeding apparatus for bale forming prior to binding operation, and a method of spontaneous fall of the bales sidewise of the apparatus, so that the whole can be accomodated and concealed within a cabinet-like chest having two doors, of which one for refuse discharge and the other for removal of formed bales; thus, the work environment would be improved also from aesthetical standpoint.

SUMMARY OF THE INVENTION

Particularly, the apparatus comprises a parallelepiped chamber, wherein at the bottom provision is made for a vertically upward moving plate piston and driving means for lifting and withdrawing the same, which means may be either mechanical or pneumatic or the like; a hopper located just above the bottom position of the piston for loading the material to be baled or packed; a plurality of members for stopping the compressed material at the highest level of the piston, these members being moved away from the upward moving piston and becoming operative as the piston is lowered; the top portion of two opposite faces of the parallelepiped being approchable by acting upon two upper side handwheels in order to squeeze the block of pressed material prior to binding. In view of this particular expedient, the plan or bottom of this parallelepiped container can be of a rectangular shape with the minor sides corresponding to the two upper movable walls, so that the end approach thereof would make equal the two major sides and provide for a bale of square cross-section.

An embodiment of the apparatus for feeding the material to be formed in bales will now be described, by mere way of example, for forming thereof from the bulk material to be baled or packed.

BRIEF DESCRIPTION OF THE DRAWINGS

In the accompanying drawings:

FIG. 1 is a sectional view substantially taken along line 1—1 of FIG. 2, and showing part of the binding device at closed position;

FIG. 2 is a side view showing one of the arcuate guide means of the device, such as in the direction of arrow 2 in FIG. 1;

FIG. 3 is a view similar to FIG. 1, but with the binding wires arranged on the core after wrapping operation;

FIG. 4 shows a knot or wrap on the end of a bale or pack, such as obtained through the subject device;

DETAILED DESCRIPTION OF A PREFERRED EMBODIMENT

Figure 5:
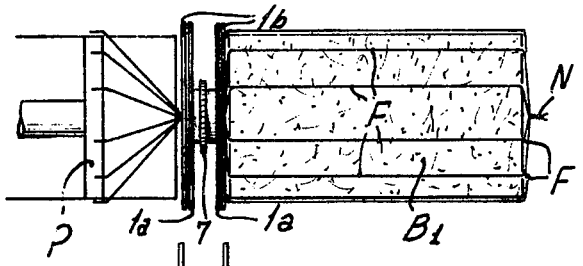
FIGS. 5 and 6 and FIGS. 7 and 8 are schematic side (FIG. 5), top (FIG. 6) and front (FIGS. 7 and 8) views, respectively, several respective positions for the device and bales or packs to be bound at various operation steps.

It should be noted that such terms as "top", "bottom", "upward", "downward", "right" and "left" and the like are herein used only by reference to the embodiment of the device and apparatus shown in the drawings, and not in a limiting sense.

The device, although being shown in the drawings as horizontally arranged, could be as well vertically or otherwise arranged.

As it will be seen with reference to FIGS. 1, 2 and 3, a binding device according to the invention comprises two arcuate elements 1*a* and 1*b*, the elements facing each other and being movable relative to each other as explained in the following.

Each of the elements 1*a* or 1*b* comprise two plates 2*a* for the element 1*a* and 2*b* for the element 2*b*, respectively, substantially parallel arranged and spaced apart from one another by a spacing which is different for the element 1*a* and the element 1*b*, for example as shown in the drawings, so that the plates 2*a* can be accomodated between the plates 2*b*. Each of the plates 2*a* or 2*b* are as high as, or somewhat higher than the bale to be formed and bound and have a concave side 3*a* or 3*b* facing the opposite plate. This concave side accomplishes the function of taking up the binding wires, causing the latter to converge to a central area 4, defined between the two arcuate elements, and therefore each of the sides 3*a* or 3*b* will have a profile designed to this purpose. The overall height of the plates 2*a*, 2*b* is equal to or larger than that of the bale to be bound.

A half-ring 5*a* or 5*b* is made fast (FIG. 2) with each of the plates 2*a* or 2*b* at a position extending to the other plate 2*b* (or 2*a*) and therefore to the corresponding half-ring on that plate. In the embodiment shown in the drawings, each of the half-rings form part of a box portion 6 (6*a* or 6*b*) attached to each of the plates.

A half-gear wheel 7*a* and 7*b*, respectively, is carried between the two half-rings of each pair of plates 2*a* or 2*b*; when connected, the two halves forming the external toothing wheel 7. At each side, this wheel 7 carries on two concentric circumferences two sets of rollers 8 and 9 extending along the axis of the wheel for engaging the half-rings 5*a* and 5*b* on the inner side thereof (rollers 9) and on the outer side thereof (rollers 8). Therefore, said half-rings operate as support and guide means for the roller sliding movement, that is for rotating the two half-wheels about the common center.

The two half-wheels 7*a* and 7*b* define a free space there-between, at least partly corresponding to said central area 4 as formed between the arcuate elements. Each of the half-gear wheels 7*a* or 7*b* carry a preferably frusto-conical spoke 10*a*, 10*b* extending within said free space, these spokes being arranged to coaxially join at the closed position for said two half-wheels to form a single pin. To this end, provision can be made on one of the two spokes for a male element suitable to connect with a female element provided on the other spoke (FIGS. 1 and 3). When connected, said spokes 10*a* and 10*b* divide the opening or free area 4 into a top area 4' and a bottom area 4''.

Each of the arcuate elements 1*a* or 1*b* are carried on a frame 11*a* or 11*b*, which are slidable, for example, within guide sleeves 12*a* and 12*b* and are driven, for example, by a piston system 13*a* and 13*b* only partially shown.

The above mentioned gear wheel 7 is rotably driven by any desired system, such as a gear drive or, as shown in FIG. 3, by a continuous chain 14 engaging on the toothing thereof, and driven by a pinion controlled by a motor 15.

The operation of the device will be described with particular reference to FIGS. 5, 6, 7 and 8, bearing in mind that the operation sequence is as follows: FIGS. 7, 8, 5 and 6.

Figure 6:
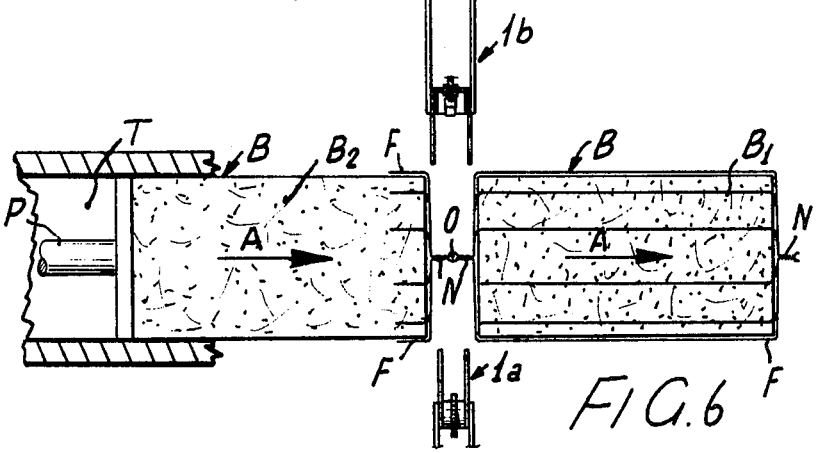
Figure 7:
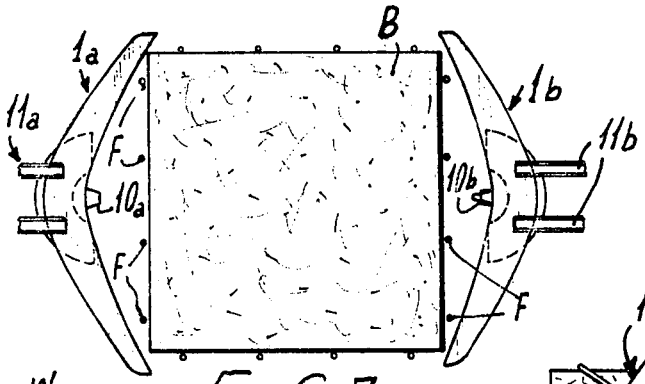
Figure 8:
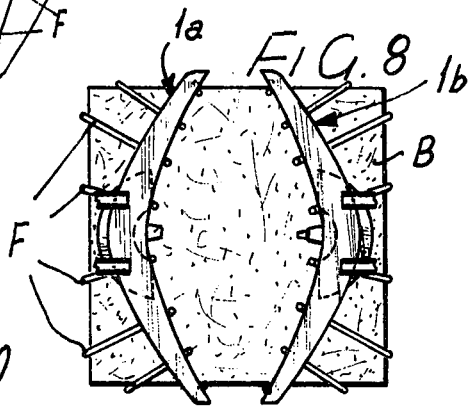

The material to be formed in a bale, such as pieces of paper, hay and the like (or in the case of a preformed pack, the pack itself), is forwardly moved along a tunnel T according to the arrows A by any desired system, for example by a piston P. On one hand, the binding wires F are interlaced in a knot N, formed by a preceding binding operation, in front of the leading edge of the bale that will be formed, and on the other hand said wires F come from supply or delivery means placed in the walls of the tunnel, or outside of it, such as wire rolls, from each of which the wire is unwound passing through a hole in the tunnel wall. In this operation step, (see FIG. 7), the binding devices 1*a* and 1*b*, lying on a plane substantially transverse of the feeding direction, are moved away from the path of the forming bale, which, on forwardly moving, will unwind the wires F wrapping it up. When the bale arrives at the position taken by the bale $B_1$, as shown in FIG. 6, the elements 1*a* and 1*b* will move close to each other (FIG. 8). In this movement, each of the elements 1*a* and 1*b* will through their concave surfaces take up and converge in correspondence to an axial central length the binding wires which, upon completion of the approaching movement of said elements 1*a* and 1*b*, will be partly arranged over the former pin 10, and partly beneath thereto (FIG. 1). The two half-gear wheels 7*a* and 7*b* are now caused to rotate through a few revolutions, these half-gear wheels contacting and forming the single wheel 7. Due to this movement, is also rotated around its own axis (which is also the longitudinal central axis of the gear wheel), winding wires F around one another and twisting them upstream and downstream of core or spoke 10. Upon completion of the desired amount of revolutions, and when the two half-wheels have been brought back to such positions as to move the elements 1*a* and 1*b* away from each other, these elements will accordingly be moved away and back to the rest or inoperative position thereof clear of the bale path, which pin can be readily removed from the eyelet 0 formed between the wires. Of course, said wires would maintain the winding or wrapping attitude as imparted thereto, and are cut within the eyelet O to separate the formed bale. The knot N, as obtained on a bale B, is as shown in FIG. 4.

Figure 9:
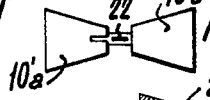
FIG. 9 is a view showing a cutting device at the position for cutting.
Figure 10:
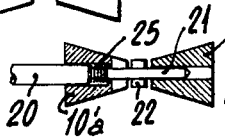
FIG. 10 is a longitudinal sectional view taken along the device shown in FIG. 9.
Figure 12:
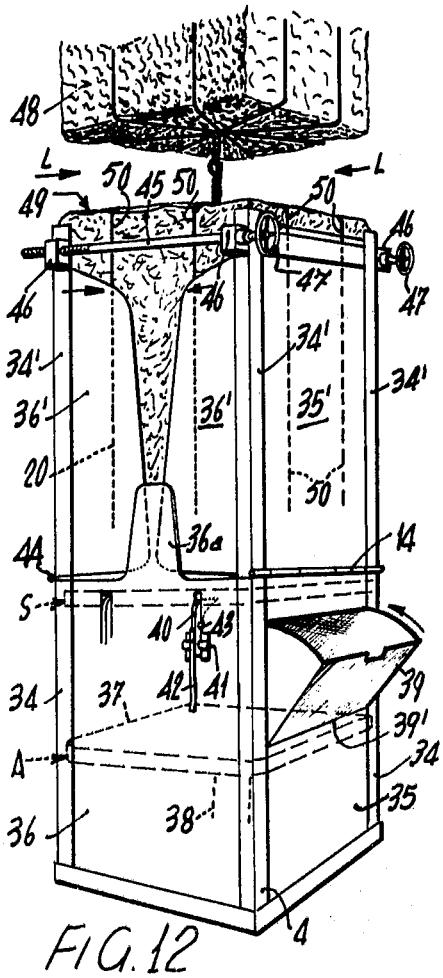
FIG. 12 is a perspective view showing the whole apparatus for bale forming bulk material, such as office paper waste.

The cut operation of the eyelet O can be manually carried out, or by any desired means. Particularly, provision was made for the device shown in FIGS. 9, 10, and 11 and described in the following.

In this case, the spokes 10*a* and 10*b* are replaced by the spokes 10'*a* and 10'*b*. which are internally provided with axial through openings; the opening 25 in one of the spokes, such as spoke 10'*a*, accomodates a sliding plunger 20 extending in a rod 21 projecting from the drilled spoke 10'*a*. Said rod 21 carries two radial blades 22, the cutting edge of which faces the spoke 10'*b*. A spring 23 is effective between a shoulder in the opening of the spoke 10'*a* and the head of said plunger 20. The spoke 10'*b* has a surface 24 for cutting co-action with said blades 22, and an axial opening 26 for accomodating said rod 21.

Figure 11:
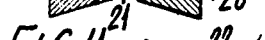
FIG. 11 is a sectional view similar to FIG. 10, but showing the cutting blades at retracted position.

At the rest or inoperative position of the cutting device, that is when the elements 1*a* and 1*b* are moved away from each other, or are approaching, said spring 23 urges said plunger 20, holding the blades 22 within the suitable housings in the spoke 10'*a*. When the elements 1*a* and 1*b* are at their closest position, said rod 21 is partly engaged within the opening 26, and partly free within the space between the spokes 10'*a* and 10'*b* (FIG. 11). The gear wheel 7 is now rotated, as above mentioned, and the wires are twisted or interlaced on the free portion of the rod 21, thus forming an eyelet. When the wheel 7, by any desired means, such as by a cylinder and piston device, the plunger 20 is urged against the force of the spring 23, thus urging the blades 22 against the surface 24 (FIGS. 9 and 10) to cut the wire eyelet. After cutting, the device is brought back to the position as shown in FIG. 11 and the elements 1*a* and 1*b* can be moved away from each other.

The apparatus for supplying the bulk material to form the bales consists of a hollow parallelepiped formed of two opposite walls 35 and two further opposite walls 36 made fast with one another by means of angular uprights 34, which defines a chamber, wherein at the bottom there is provided a horizontal plate 37 carried by central pin 38, forming as a whole a piston which from the lowermost position, shown by broken lines at A, reaches the uppermost position S. Within this section or length, provision is made on any wall for a hopper 39, with no backware wherein the material to be baled or packed is introduced and which will have the sloping wall under hinged at 39' for being closed again when the piston 37 is operated.

Figure 13:
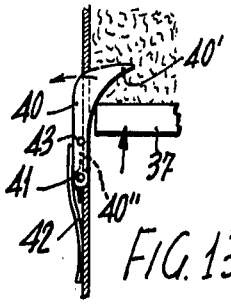
FIGS. 13 and 14 show a stop device for pressed material at operative position and retracted position, respectively.
Figure 14:
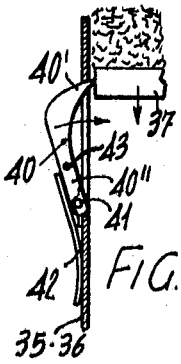

Within this section or length, provision is also made for a number of movable members for at least peripherally supporting the pressed upper block, one of these members being shown on enlarged scale in FIGS. 13 and 14. An angled pawl 40 is movable within a vertical sheet slit, having a peak 40' internally extended and a downward vertical extension 40'', at the end of which a pivot 41 is provided, and on the outer side a spring blade 42 tending to maintain said pawl constantly at forward position, that is at active position for supporting the pressed material. Furthermore, on the inner side between the tip of said peak 40' and extension 40'', said pawl 40 is of a curved shape, the edge of the upward moving piston 37 acting thereupon (FIG. 13), whereby the pawl is caused to move out of the slit (FIG. 14) and thus retained, until said piston 37 attains at such a position its highest level. Of course, as the piston 37 moves downwards, the pawl 40 will return to its active or operative position, urged thereto by the spring 42, the effect of which is cancelled when the stop rod 43 transverse of and fast with the pawl body 40 is against the sheet at the slit edges.

The top of the parallelepiped has the two walls 35' following the walls 35 separated therefrom by the horizontal hinges 44, so that said walls 35' can pivot on said hinges. Thus, at the upper ends these walls 35' are interconnected by two tie-rods 45, each of which passing through two symmetrical blocks 46, of which one is threaded for connection with a threaded end portion of the rod 45, while idly rotating in the other block when the operator acts upon the end handwheel 47 of said rod. Thus, the two walls 35' can be caused to approach, for reducing the corresponding dimension of as the block of pressed material prior to being bound. Thus, at the immediately upper area, designated by the arrows L, the binding operation according to the system as provided in FIGS. 1–11 and the separation of the finished bound bale 48 from the forming bale 49 are carried out.

The binding wires 50 are guided and supplied from the bottom in any preferred manner; for example, such wires could individually or by pair come from a roll within the lower chamber and below the plate 37, when permitted by the drive means mounted for moving said plate, or outside of said chamber at a suitably convenient position.

Since said walls 35' can be moved near each other, omission could even be contemplated for walls higher of the walls 36. However, in order to maintain coherent the forming block, it may be convenient to provide the upper uprights 34' with two half-walls 36' forming a continuity even though not complete of the walls 36. At the top center line, the latter could have an upward extension **36*a* for reinforcing and containing the bases of the walls 36'**.

Figure 15:
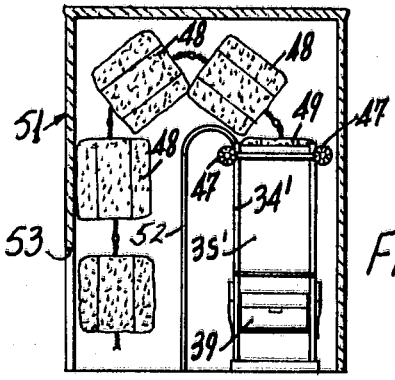
FIG. 15 shows the processing diagram for the apparatus and the overall size range for any cabinet-like chest to contain and conceal the same.

A practical embodiment is given in FIG. 15 for a possible installation of the apparatus within a cabinet-like chest 51, also enclosing the sidewise falling bales 48. The chest, which is closed on all of the sides, includes a curved guide 52 for separating the loading side from the removal side and will have a door at the loading hopper 39, and a door 53 corresponding to the on-ground bales for removal of the latter.

As apparent, while remaining valid the peculiar features characterizing the present invention, any constructive variation relating to improvements to the component members without altering the function thereof and objects, would of course be within the covering scope of the present invention.

I claim:

1. An apparatus for compressing material comprising: a hollow chamber defined by a plurality of walls, at least two of the walls being opposite and spaced apart from each other, a piston-plate, means for moving the piston-plate in the chamber between maximum inner and outer limits, a hopper in one of the walls located between the two maximum limits of movement of said piston-plate through which material can be introduced into the chamber, a plurality of engaging means located at the maximum outer limit of the piston-plate for engaging said compressed material and stopping rearward movement thereof, adjusting means for adjusting the distance between portions of the opposite walls located beyond the outer limit of the piston-plate, each wall including first and second portions, the first portions of adjacent walls being connected to each other, the second portions of the opposite walls being hinged to their respective first portions, a pair of adjustable tie-rods connected at the outer end of said opposite walls for adjusting and maintaining the distance therebetween, said hinged first portions of the walls being provided on both sides with symmetrical semi-walls for forming the second portions of the other walls, the first portions of the other walls each including an upward extension located outwardly of the semi-walls for holding the latter in place.

2. An apparatus as set forth in claim 1, wherein the portion of the said chamber where the piston-plate is movable is rectangular in cross-section with the minor sides at the two movable wall portions, while the outlet opening for the compressed material is generally square as a result of said two movable wall portions being moved near each other.

3. An apparatus as set forth in claim 1, wherein each engaging means comprises an angle-shaped pawl having an inwardly extended peak and a downward vertical extension, pivoted at its end and on one of said walls and moving within a corresponding slit of the wall, a spring for maintaining the pawl constantly at a forward position, the pawl having an inner profile, connecting the lower shank to the peak end, comprising a curve shaped so that the upwardly moving piston will outwardly urge the pawl to an inoperative position, the maximum outer limit of the piston being adjusted so as to reach the height of the peaks of these members, the peaks being released as the piston moves toward the inner maximum limit.

4. An apparatus for compressing material comprising: a hollow chamber defined by a plurality of walls, at least two of the walls being opposite and spaced apart from each other, a piston-plate, means for moving the piston-plate in the chamber between maximum inner and outer limits, a hopper in one of the walls located between the two maximum limits of movement of said piston-plate through which material can be introduced into the chamber, a plurality of engaging means located at the maximum outer limit of the piston-plate for engaging said compressed material and stopping rearward movement thereof, adjusting means for adjusting the distance between portions of the opposite walls located beyond the outer limit of the piston-plate, a cabinet-like chest for enclosing the entire apparatus, said chest including a passage alongside the chamber for the formed bales, said chest further including at least one door at the hopper and one output door for the formed bales.

* * * * *

UNITED STATES PATENT AND TRADEMARK OFFICE

CERTIFICATE OF CORRECTION

PATENT NO. : 4,108,064
DATED : August 22, 1978
INVENTOR(S) : GIORGIO CERIBELLI

It is certified that error appears in the above-identified patent and that said Letters Patent are hereby corrected as shown below:

Col. 4, line 1, after "movement," insert -- the pin 10 --;

Col. 4, line 11, after "eyelet", "0" should read -- O --;

Col. 4, line 60, "backware" should read -- back wall --.

Signed and Sealed this

*Twenty-fourth* Day of *April 1979*

[SEAL]

*Attest:*

RUTH C. MASON
*Attesting Officer*

DONALD W. BANNER
*Commissioner of Patents and Trademarks*